United States Patent [19]

Pinto

[11] 4,146,961

[45] Apr. 3, 1979

[54] SCISSORS

[76] Inventor: Frank Pinto, 1832 Meadowbrook Rd., Abington, Pa. 19116

[21] Appl. No.: 848,531

[22] Filed: Nov. 4, 1977

[51] Int. Cl.[2] ..... B26B 13/12

[52] U.S. Cl. ..... 30/341; 30/271

[58] Field of Search ..... 30/254, 256, 257, 260, 30/341, 271

[56] References Cited

U.S. PATENT DOCUMENTS

| | | | |
|---|---|---|---|
| 430,677 | 6/1890 | Pearsall | 30/341 |
| 1,479,908 | 1/1924 | Goshia | 30/341 |
| 2,158,277 | 5/1939 | Dolph | 30/341 |
| 2,744,324 | 5/1956 | Chuba | 30/341 X |

*Primary Examiner*—Jimmy C. Peters

*Attorney, Agent, or Firm*—Seidel, Gonda, Goldhammer & Panitch

[57] ABSTRACT

Scissors including a finger loop and extending generally along a shank on one blade with a thumb loop on the shank of the second blade and generally perpendicular thereto. The thumb loop is adjustable along the shank of the second blade, is held in place by a limit stop extending between the blade shanks, and may be removed so that a different shaped loop can be substituted.

8 Claims, 4 Drawing Figures

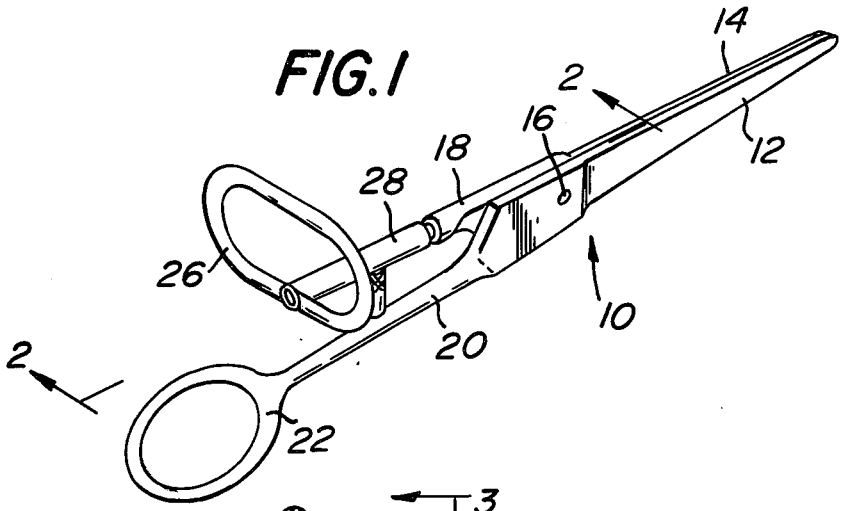
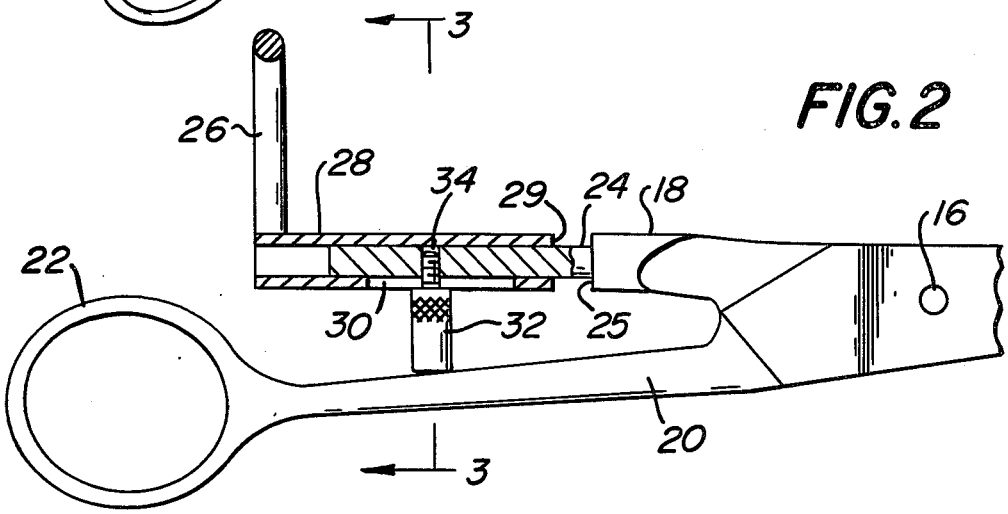
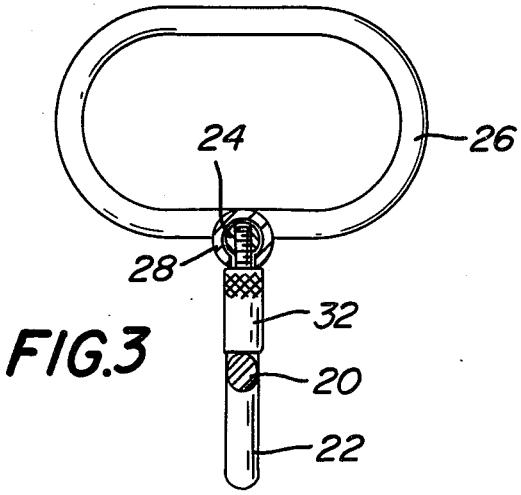
FIG. 3
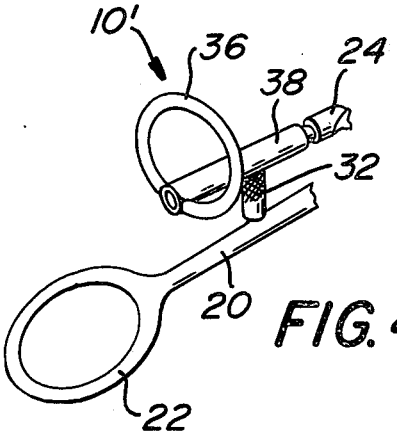
FIG. 4

SCISSORS

BACKGROUND

U.S. Pat. No. 183,755 discloses scissors wherein the thumb loop is perpendicular to its shank and the finger loop lies along its shank. The prior art does not provide a scissors constructed in a manner so that the thumb loop is adjustable along the length of its shank whereby the scissors will be more universal in being properly adjustable to the size of the hands of different persons. Further, the prior art does not have a plurality of thumb loops of different sizes and shapes which may be substituted for one another so that a thumb loop may be chosen which closely conforms to the shape of the thumb of the user.

SUMMARY OF THE INVENTION

The scissors of the present invention comprise first and second blades pivoted together in a conventional manner. Each blade has a shank terminating in a loop. The loop on the first blade being a finger loop lying generally along the plane of its shank. The loop on the second blade being a thumb loop lying generally perpendicular to the plane of its shank. The thumb loop is preferably adjustable along its shank. A limit stop on one of the shanks is provided for contacting the other shank in the closed position of the blades.

It is an object of the present invention to provide a novel pair of scissors which is more universal in it application to different sized hands of the user while being simple, inexpensive, and reliable.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is a prespective view of a first embodiment of the present invention.

FIG. 2 is a partial side elevation, partly in section, and illustrating the scissors of the present invention on an enlarged scale as compared with FIG. 1.

FIG. 3 is a sectional view taken along the line 3—3 in FIG. 2.

FIG. 4 is a partial perspective view of the scissors in FIG. 1 but modified by having a different thumb loop substituted for the thumb loop shown in FIG. 1.

Referring to the drawing in detail, wherein like numerals indicate like elements, there is shown in FIG. 1 a pair of scissors designated generally as 10.

The pair of scissors 10 includes a first blade 12 and a second blade 14 connected together by a pivot pin 16. Blade 14 has a shank 18. Blade 12 has a shank 20 terminating in a finger loop 22.

As shown more clearly in FIG. 2, shank 18 has a reduced diameter portion 24 which is an extension of shank 18 at the shoulder 25. A thumb loop 26, generally elliptical as shown in FIGS. 1 and 3, is attached to one end of a sleeve 28. Sleeve 28 is adjustable along portion 24. Thus, loop 26 and sleeve 28 may be adjusted toward the blade 14 until end face 29 on sleeve 28 contacts the shoulder 25. Thus, shoulder 25 acts as a limit stop for the sleeve 28 as the sleeve 28 is adjusted toward the blade 14.

Sleeve 28 is preferably provided with an elongated slot 30 immediately above the shank 20. A limit stop 32, which is similar to a set screw, extends through the slot 30 and is threaded in hole 34 on portion 24. The end of slot 30 adjacent shoulder 25 acts as a limit stop when the sleeve 28 is moved in a direction away from the shoulder 25. In any adjusted position of the loop 26 and sleeve 28, they are selectively retained in such adjusted position by tightening the limit stop 32. When limit stop 32 is tightened so as to contact the periphery of sleeve 28 alongside the slot 30, it is in the proper position for contact with the shank 20 simultaneous with the blades 12 and 14 being in their closed position.

Since the loop 26 is generally perpendicular to its shank, the scissors may be held as an extension of the arm with the index finger extending through loop 22 and the thumb extending through loop 26 and along the shank 18. With the scissors 10 in an open disposition, limit stop 32 may be rotated in the appropriate direction so that loop 26 and sleeve 28 may be slideably positioned along portion 24 to the proper location with respect to the length of the user's thumb. Then limit stop 32 is rotated in the opposite direction to retain the sleeve 28 in such predetermined position considered to be most comfortable by the user.

In FIG. 4, there is illustrated a portion of a pair of scissors in accordance with another embodiment designated generally as 10'. The scissors 10' are the same as scissors 10 except that the loop 36 attached to a sleeve 38 has been substituted for the loop 26 and its sleeve 28. That is, complete removal of the limit stop 32 from the threaded hole 34 facilitates removal of loop 26 and its sleeve 28. The present invention contemplates a pair of scissors having a plurality of thumb loops of different shape so that the user may select the shape most comfortable to the user. Scissors 10' are otherwise identical to scissors 10.

In view of the above description, it will be noted that the scissors of the present invention have a thumb loop generally perpendicular to the plane of its shank while being adjustable along it shank so that the thumb loop is in the most comfortable position for the user. Another feature of the present invention is the ability to substitute thumb loops of different shapes so that the user may use a shape of thumb loop which is most comfortable. At the same time, the limit stop is utilized as a means for retaining the thumb loop in a predetermined position along its shank.

The present invention may be embodied in other specific forms without departing from the spirit or essential attributes thereof and, accordingly, reference should be made to the appended claims, rather than to the foregoing specification as indicating the scope of the invention.

I claim:

1. A pair of scissors comprising first and second blades pivoted together, each blade having a shank terminating in a loop, the loop on the first blade being a finger loop aligned generally along a plane of its shank, the loop of the second blade being a thumb loop lying generally perpendicular to the plane to its shank, said thumb loop being adjustable along its shank, a limit stop on one of the shanks for contacting the other shank in a closed position of said blades, said thumb loop being telescopically adjustable along its shank by means of a sleeve connected thereto and movable therewith, said thumb loop and its sleeve being retained in a predetermined position along its shank by means of said limit stop, said sleeve having an elongated slot, and a portion of said limit stop extending through said slot and being threadedly connected to the shank on said second blade.

2. A pair of scissors in accordance with claim 1 wherein said thumb loop is removably connected to its shank so that different thumb loops may be substituted for one another.

3. A pair of scissors in accordance with claim 1 wherein said thumb loop is generally elliptical.

4. A pair of scissors in accordance with claim 1 wherein said thumb loop is generally circular.

5. A pair of scissors comprising first and second blades pivotably connected together, said first blade having a first shank, said second blade having a second shank, said first shank being shorter then said second shank, each shank terminating in a loop, the loop on said first shank being a thumb loop extending generally perpendicular to the first shank, said thumb loop beng generally elliptical, the loop on said second shank being a generally circular finger loop lying generally along the axis of said second shank, a limit stop supported by said first shand and generally perpendicular thereto, said limit stop having one end threadedly coupled to said first shank and having a contact surface at its other end for contact with said second shank in the closed disposition of said blades.

6. A pair of scissors in accordance with claim 5 wherein said thumb loop is connected to one of a sleeve, said sleeve being telescopically arranged with respect to said first shank.

7. A pair of scissors in accordance with claim 6 wherein said sleeve has a elongated slot parallel to the longitudinal axis of the sleeve, said limit stop having a portion extending through said slot, said sleeve being slideable along said first shank until an end of the slot contacts said limit stop.

8. A pair of scissors in accordance with claim 5 wherein said limit stop constitutes a means for removably connecting the thumb loop to the first shank so as to facilitate substitution of a different shaped loop on the first shank.

* * * * *